US012188335B2

(12) United States Patent
Svalov

(10) Patent No.: US 12,188,335 B2
(45) Date of Patent: Jan. 7, 2025

(54) METHOD OF INCREASING WELL BOTTOMHOLE RESISTANCE TO DESTRUCTION

(71) Applicant: PUBLICHNOE AKTSIONERNOE OBSCHESTVO "GAZPROM", Saint-Petersburg (RU)

(72) Inventor: Aleksandr Mikhajlovich Svalov, Moscow (RU)

(73) Assignee: PUBLICHNOE AKTSIONERNOE OBSCHESTVO "GAZPROM", Saint-Petersburg (RU)

( * ) Notice: Subject to any disclaimer, the term of this patent is extended or adjusted under 35 U.S.C. 154(b) by 0 days.

(21) Appl. No.: 17/610,385

(22) PCT Filed: Jul. 27, 2020

(86) PCT No.: PCT/RU2020/000393
§ 371 (c)(1),
(2) Date: Nov. 10, 2021

(87) PCT Pub. No.: WO2021/025590
PCT Pub. Date: Feb. 11, 2021

(65) Prior Publication Data

US 2022/0259951 A1 Aug. 18, 2022

(30) Foreign Application Priority Data

Aug. 2, 2019 (RU) ..... RU2019124673

(51) Int. Cl.
*E21B 7/28* (2006.01)
*E21B 7/20* (2006.01)
(Continued)

(52) U.S. Cl.
CPC ..... *E21B 43/02* (2013.01); *E21B 7/28* (2013.01); *E21B 43/12* (2013.01); *E21B 7/20* (2013.01)

(58) Field of Classification Search
CPC ..... E21B 7/20; E21B 7/28
See application file for complete search history.

(56) References Cited

U.S. PATENT DOCUMENTS 2,504,462 A * 4/1950 Sprague ..... E21B 33/134 166/195
3,022,986 A * 2/1962 Brandt ..... E21B 43/28 299/5

(Continued)

FOREIGN PATENT DOCUMENTS

RU 2095542 C1 11/1997
SU 1048110 A1 10/1983

OTHER PUBLICATIONS

International Search Report and Written Opinion for corresponding PCT application No. PCT/RU2020/000393, mailed Jan. 20, 2021.

*Primary Examiner* — Kenneth L Thompson
(74) *Attorney, Agent, or Firm* — Notaro, Michalos & Zaccaria P.C.

(57) ABSTRACT

A method for improving the stability of reservoir rock in bottomhole zones of wells to destructive loads developing during operation of wells at oil and gas fields during operation at underground gas storages is disclosed. Prior to running of casing string in zone of contact of productive formation with its impenetrable roof it is proposed to drill or blur cone-shaped cavern with vertex facing the formation, the cavity parameters must satisfy the conditions according to the depth of the cavity counted from the well wall along the contact line of the productive formation and its impermeable roof should exceed 4 cm, and the angle between the cone generatrix and the casing pipe generatrix within the (Continued)

Figure 1A:
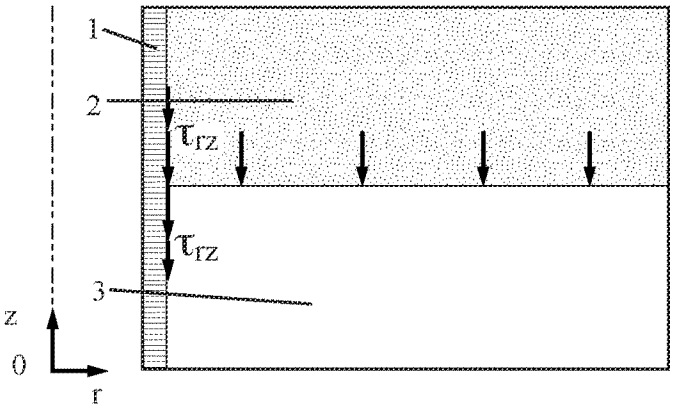

range of values from 5° up to 30°. This will increase well bottomhole zone stability to destructive loads developing in process of its operation and reduction of volumes of broken rock carried to well bore.

2 Claims, 1 Drawing Sheet

(51) Int. Cl.
*E21B 43/02* (2006.01)
*E21B 43/12* (2006.01)

(56) References Cited

U.S. PATENT DOCUMENTS

| | | | | |
|---|---|---|---|---|
| 4,189,184 | A * | 2/1980 | Green | E21B 43/29 299/8 |
| 6,250,391 | B1 * | 6/2001 | Proudfoot | E21B 43/35 166/265 |
| 7,350,584 | B2 * | 4/2008 | Simpson | E21B 43/103 166/207 |
| 9,631,437 | B2 * | 4/2017 | Dale | E21B 17/18 |
| 2018/0274341 | A1 * | 9/2018 | Dallas | E21B 43/261 |

* cited by examiner

METHOD OF INCREASING WELL BOTTOMHOLE RESISTANCE TO DESTRUCTION

This invention relates to oil and gas production industry and can be applied to improve resistance of a reservoir rock in well bottom zones to yield loads developed in the process of well operation at oil and gas fields, as well as during operation of wells at underground gas storage facilities (UGS).

Withdrawal of sand to the well bore results in complications during operation thereof due to formation of sand plugs in the bore that obstruct rise of formation fluid to surface, and results in increased wear and tear of downhole equipment. Methods to counter withdrawal of decayed rock particles to the well bore by reduction of the well flow rate, installation of sand screens of different design are known. Disadvantages of these methods are reduction of well output, reduction of its deliverability due to filtration resistance of the well bottom zone in case the screens are clogged, and increased failure of screens in case of intensive sand withdrawal (Z. S. Aliyev, S. A. Andreyev, A. P. Vlasenko et al., Processing Behavior of Gas Wells.—Moscow: Nedra, 1978.—279 p.; D. Suman, R. Ellis, R. Snyder, Sand Control Handbook.—Moscow: Nedra, 1986.—176 p.).

Method which is most similar to the method claimed is the method of reaming of the well bottom zone using reamers of various types with further cementing of the cavern that formed or filling it with a sand-gravel mix serving as a screen that holds decayed rock particles. Disadvantage of this method is formation of stress concentration zones in the well bottom zone when formation pressure changes, and lack of cavern edge resistance to yield loads conditioned thereby (A. D. Bashkatov, Innovative Technologies in Well Construction.—Moscow: Nedra-Businesscenter, 2003.—556 p.).

Technical problem solved by the present invention is improvement of well bottom zone resistance to yield loads developed during operation thereof.

The technical problem is solved by means of the method of improvement of well bottom zone resistance to yield that includes boring a well, running a casing, and cementation of the borehole annulus, wherein, prior to running a casing, within the zone of contact of producing formation with the impermeable top thereof a tapered cavern having a top directed towards the formation inner part is jet-broken, and cavern parameters meet the requirements of:

$$R_c - R - \delta \geq 4 \text{ cm},$$

$$5° \leq \alpha \leq 30°,$$

where $R_c$ is the radius of cavern measured from the well axis along the contact surface between the producing formation and its top, cm;

R is the well radius measured from the well axis to the casing inner surface, cm;

$\delta$ is casing wall thickness, cm;

$\alpha$ is the angle between the cavern generatrix and casing, deg.

Outer surface of the casing within the zone of cavern formation is ribbed.

FIG. 1*a* shows shear stress development on the outer wall of a casing upon pressure drop in a producing formation.

Figure 1B:
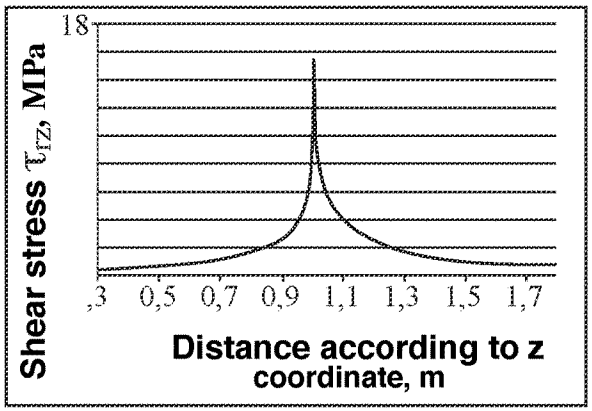

FIG. 1*b* shows shear stress distribution within the area of its concentration near the line of contact between formation and its top.

Figure 2A:
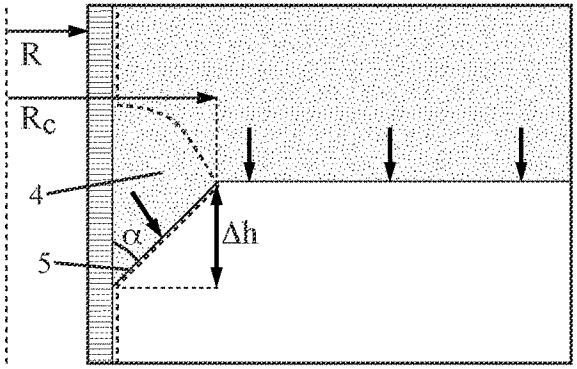

FIG. 2*a* schematically shows the nearwellbore zone with cemented cavern in the shear stress concentration area on the casing wall.

Figure 2B:
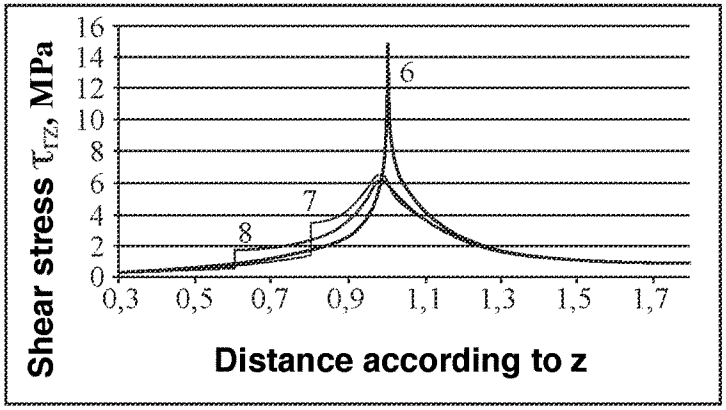

FIG. 2*b* shows distribution of shear stress at different parameters of the cemented cavern.

Number 1 on the drawings indicates casing, number 2 indicates impermeable rock in the formation top, and number 3 indicates rock in the producing formation. Arrows indicate compression stress applied to the formation from its top side upon formation pressure drop. Variables r, z indicate coordinates in radial and vertical directions, variable $\tau_{rz}$ and arrows indicate shear stress on the casing outer wall that develops upon pressure drop in the producing formation. Cavern is tapered and is to be cemented after running of casings, and is indicated with number 4; number 5 is the line corresponding to the line of the surface of contact between the cement stone and reservoir rock; number 6 indicates distribution of shear stress along the casing wall without a cemented cavern; number 7 indicates distribution of shear stress along the casing wall without a cemented cavern and at $\Delta h$=20 cm, and number 8—the same at $\Delta h$=40 cm.

Upon formation pressure drop, significantly large shear stresses are developed in the cement sheath that rigidly links the rock with other casing pipes (FIG. 1*a*). Shear stress achieves maximum values near the formation top, that is, near the surface of contact between saturated permeable and impermeable rocks (FIG. 1*b*). For the purpose of research of ways to improve well bottom zone resistance to decay, numerical calculation of the problem was carried out in accordance with the following provided modification of the well design (FIG. 2*a*).

During numerical calculation of provided modification of the well design, it was assumed that elastic constants of the cemented cavern coincided with the constants of rock in the formation top, and the remaining constitutive parameters were assumed as the same as in previous calculations results of which are given in FIG. 1*b*. For simplification of calculations, cement stone parameters in the borehole annulus were also assumed as equal to the rock parameters. FIG. 2*b* shows distribution of shear stress along the casing wall at cavern depth of $R_c$=15 cm ($R_c$−R−$\delta$=4 cm).

In physical terms, mechanism of concentration of yielding shear stress on the casing surface can be explained as follows. Upon formation pressure drop, additional vertical load on the rock is taken up by the formation carcass and results in compression thereof. Steel casings representing a rigid inclusion inside a deformable medium will prevent it from compression which results in increase in shear (tangential $\tau_{rz}$) stress on the pipe surface and in the rock near this surface. For the purposes of simplification, FIG. 1 does not have the cement sheath area indicated around the casing, and difference of elastic behavior of cement stone from similar rock characteristics was omitted during numerical calculations. Such simplification is based on the fact that the dominating influence on formation of shear stress concentration zone is provided by hardness (Young's modulus) of the steel casing, and it is significantly higher (more than tenfold) in comparison with hardness of rock and cement stone.

However, it is important to note that, despite being somewhat remote from the range of casing shear stress peak values, the contact surface between cement stone and rock, nevertheless, remains one more zone of yield stress development, since there is an intermediate layer between the cement stone and rock provided by the residual clay cake formed in the well boring process that has low shear strength.

Decay of link between the casing (cement stone) and the reservoir rock itself is not the source of withdrawal of sand and rock microparticles in significant amounts that come to the well together with gas flow, but it is the cause of activation of the decay process of the reservoir rock in other stress concentration areas within the well bottom zone. Such zones of concentration of excessive strain resulting in formation of large amount of decayed rock are surroundings of perforation tunnels. Indeed, as it appears from explicit solutions of elasticity theory that describe distribution of stress within the surroundings of an elliptic cavity, concentration of compression or tension stresses occurs near such cavities, and stress peak value magnitude exceeds the magnitude of the external load by many-fold.

It follows from the above that strong, intact link between the casing and cement stone, as well as between the cement stone and reservoir rock prevents rock from shearing along the casing that, in this case, will take up a considerable amount of external load applied on perforation tunnels due to its higher hardness (Young's modulus). When this link is disrupted, rock will move along the casing, and all excessive load conditioned by change of formation pressure will be applied to perforation tunnels causing decay thereof, which is the main cause of withdrawal of large amounts of decayed rock particles to the well bore.

The essence of the invention is as follows.

Upon completion of well boring, prior to running casing 1, a tapered cavern 4 is jet-broken within the contact area between producing formation 3 and its impermeable top using reamers, and this cavern is to be cemented after completion of casing running and is to have depth according to radius $R_c$ (cm) measured from the well axis (or depth of $R_c-R-\delta$ measured from the well wall) along the line of contact between the producing formation and its top, and is to have height $\Delta h$ (cm) in producing formation 3 and respective angle between the generatrices of the taper and casing 1. However, the taper top is directed towards producing formation 3. Availability of such cemented, that is, hard cavern 4 shall, first of all, move the point of peak shear stress down and, secondly, reduce this peak shear stress due to the fact that compression loads applied to the formation (indicated by arrows) in cavern 4 are not applied vertically downstream along casing 1, but at a certain angle in relation thereto. In general, formation of such cavern 4 shall result in "spreading" of shear stress concentration zone on casing 1 and in reduction of the maximum values thereof and, accordingly, ensure increase in resistance of this zone to decay.

The most suitable reamers for formation of the cavern of said profile are water jet reamers that jet-brake rocks using high pressure liquid jets, since the tapered shape of cavern required in this case is achieved by varying the flow rate of liquid from nozzles, rate of water jet reamer movement along the well axis, and rotation speed thereof. Upon formation of cavern, well construction is continued in a conventional manner—a casing with lateral ribs preliminarily welded thereon is run within the area of cavern formation, cementing of the borehole annulus, perforation of production range, well completion, etc. are carried out.

Numerical calculations were carried out for the scenario of formation pressure drop by 10 MPa with different combinations of cavern $\Delta h$ and $\alpha$ parameters.

Representative results of calculations are given in FIG. 2*b*. Young's modulus E of a steel pipe was assumed as equal to $2.2\cdot10^5$ MPa, in the formation top rock $E=10^4$ MPa, in the reservoir rock $E=5\cdot10^3$ MPa. Poisson's ratio in all elastic media was assumed as 0.3. Well radius R (cm) was assumed as 10 cm, casing thickness $\delta$ (cm) was assumed as 1 cm. The value of z=1 m corresponds to the point of top and producing formation contact. As it appears from curves shown in FIG. 2*b*, availability of cemented cavern results in considerable reduction of shear stress peak values. Instead of the initial value of ~15 MPa in point z=1 m, magnitude of shear stress in this point is within the range of ~6 MPa, and stress values in another peak point—the taper top (z=80 cm and z=60 cm)—are considerably less than 6 MPa.

Calculations show that decrease of angle results in reduction of shear stress magnitude at the taper top, but in increase thereof in point z=1 m, and increase in cavern depth $R_c$ results in reduction of the peak value in this point. Numerical calculations have shown that, at cavern depth of $R_c-R-\delta$ equal to ~4 cm, decreasing of angle between the taper generatrix and casing surface to less than ~5° results in noticeable increase in peak values of shear stress in point z=1 m, that is, to reduction of the effect of "spreading" of shear stress concentration area.

By generalization of the numeric calculations carried out with different combinations of geometrical parameters of the cavern, it can be concluded that, in case the maximum value level is assessed using both peak value points, the optimal variant is the one under the following conditions: radial depth of the cavern measured from the well wall ($R_c-R-\delta$) shall be at least 4 cm, and the angle between the taper generatrix and the casing surface shall be within the range of values from 5 to 30° which will ensure essential (~2.5 times) reduction of all the shear stress peak values in comparison with stresses without the cavern.

To amplify the effect described, it is feasible to additionally increase the adhesion strength of cement stone with the casing surface by welding ribs onto it within the cemented cavern formation zone. To prevent no flow areas from formation beside the lateral ribs when drill mud is pushed out by mortar, it is feasible to weld these ribs onto the casing under certain angle to the casing pipe generatrix which will allow for movement both of the liquid medium that pushes out and the one being pushed out along the ribs.

As can be seen in FIG. 1*b*, peak magnitude of shear stresses developed on the surface of casings in point z=1 m significantly exceeds (approximately by one and half times) the magnitude of the formation pressure in the deposit. With due account for the fact that, during gas field development and gas flooding and extraction in UGS wells, pressure difference in the formation may reach 10-15 MPa and more, and therefore, peak values of shear stress reach ~15-20 MPa, and cement stone shear strength does not exceed these magnitudes, it can be affirmed that rigid link between casings and reservoir rock in the process of well operation inevitably decays, especially under conditions of cyclical nature of gas flooding-extraction from the UGS.

Let us note that, according to the items described herein, cavern top part shape is of no crucial nature, and the only important aspect is that this shape would also ensure quality filling of the cavern with mortar during well cementation.

It is important to put emphasis on the following circumstance. As it was noted above, on the contact surface between the cement stone and rock there will be inevitable remains of clay cake that is formed on the well walls during drilling process which considerably reduces strength of the cement stone adhesion with the rock. As it appears from the calculations that were carried out, magnitude of yielding shear stress decreases as it moves away from the casing outer surface, that is, these shear (tangential) stresses are significantly weaker on the surface of contact of cement stone and rock than the stress magnitudes on the casing wall shown in FIG. 2*b*. At the same time, with due account for adhesive strength of cement stone with rock, surface of their contact schematically shown in FIG. 2*a* with dashed line 5 can also decay which will result in vertical shear of the rock along the casing. It is apparent that formation of hard tapered cavern allows for prevention of such shear even in case adhesive strength on this surface is lost. Indeed, as it appears from FIG. 2*a*, tapered shape of cemented cavern mechanically obstructs vertical shearing of rock along the casing.

Please, note that formation of a similar tapered cemented cavern in the lower part of well bottom zone at the line of contact between the formation and the bottom thereof will also facilitate decrease in intensity of yield stresses in this part of the well. It is apparent that taper top shall be directed upwards in this case.

In case a well bore is open including reamed well bottom zone which is representative of UGS wells, the provided method of yield load reduction is also applicable, since the lower part of the cemented casing pipe experiences the same "sagging" of rock at the rigid pipe casing. Boring or jet-breaking of the cemented cavern in this zone will also result in the effect of "spreading" of yield shear stresses and in reduction of peak values thereof near the casing.

The method provided makes it possible to significantly improve resistance of the well bottom zone to yield loads developed in the process of operation thereof and, accordingly, to reduce the amounts of decayed rock withdrawing to the well bore.

Moreover, decay of the link between the cement stone, casing and rock at large parts of the well bore is the cause of flows of formation fluids between the producing formation and water saturated formations located above and below which results in increase in water cut in the extracted product, especially after hydraulic fracturing of the formation during which formation pressure at the well bottom zone increases up to 30-40 MPa and more.

Use of provided method will make it possible to reduce adverse effects of application of the producing formation hydraulic fracturing technology.

The invention claimed is:

1. A method of improvement of well bottom zone resistance to decay, comprising:

boring of a well passing through an impermeable rock formation into a producing rock formation, wherein a zone of contact is formed between the impermeable rock formation and the producing rock formation;

forming, by jet-breaking, a tapered cavern having a top directed towards a formation inner part, the tapered cavern positioned within the zone of contact between the impermeable rock formation and the producing formation;

running a casing into the well in order to form a borehole annulus between an outer wall of the casing and a wall of the well, and cementation of the borehole annulus and the tapered cavern so that the tapered cavern is completely filled with cement, the tapered cavern positioned so that a shear stress at a contact surface between the impermeable rock formation and the producing rock formation is spread away from the casing in order to increase a resistance of a well bottom zone to decay, wherein the tapered cavern parameters meet the requirements of:

$$R_c - R - \delta \geq 4 \text{ cm},$$

$$5° \leq \alpha \leq 30°,$$

where $R_c$ is the radius of the cavern measured from the well axis along the contact surface between the impermeable rock formation and the producing rock formation, cm;

R is the well radius measured from the well axis to the casing inner surface, cm;

$\delta$ is casing wall thickness, cm;

$\alpha$ is the angle between the cavern and casing generatrices, deg.

2. The method according to claim 1 wherein an external surface of the casing within the cavern formation zone is ribbed.

* * * * *